US005893514A

United States Patent [19]

Fletcher et al.

[11] Patent Number: 5,893,514

[45] Date of Patent: Apr. 13, 1999

[54] BLANK FOR A CONTAINER, AND A CONTAINER HAVING A CLOSING AND OPENING SYSTEM

[75] Inventors: Glenn R. Fletcher; Donna L. Schnuck; Roland A. Foubert, all of Vancouver, Wash.

[73] Assignee: Linear Products, Incorporated, Vancouver, Wash.

[21] Appl. No.: 08/963,085

[22] Filed: Nov. 3, 1997

Related U.S. Application Data

[63] Continuation of application No. 08/650,096, May 17, 1996, abandoned.

[51] Int. Cl.[6] ..... B65D 27/38

[52] U.S. Cl. ..... 229/309; 229/80; 229/311

[58] Field of Search ..... 229/309, 310, 229/311, 312, 238, 123.2, 80; 383/5

[56] References Cited

U.S. PATENT DOCUMENTS

| | | | |
|---|---|---|---|
| 1,027,994 | 5/1912 | Crawford | 229/311 |
| 2,895,865 | 7/1959 | Humphner | 229/123.2 X |
| 2,962,205 | 11/1960 | McFarland | 229/309 |
| 3,027,067 | 3/1962 | Johnson | 229/311 X |
| 3,982,689 | 9/1976 | Retrum | 229/313 X |
| 4,193,501 | 3/1980 | Allen | 229/313 |
| 4,334,611 | 6/1982 | Watson et al. . | |
| 4,624,407 | 11/1986 | Janhonen . | |
| 4,674,129 | 6/1987 | Janhonen . | |
| 4,723,658 | 2/1988 | Steel . | |
| 4,773,541 | 9/1988 | Riddell . | |
| 4,778,059 | 10/1988 | Martia . | |
| 4,781,296 | 11/1988 | Morris . | |
| 4,785,160 | 11/1988 | Hart . | |
| 4,819,807 | 4/1989 | Giger | 229/313 |
| 4,877,139 | 10/1989 | Kim . | |
| 4,899,518 | 2/1990 | Beeman et al. . | |
| 4,930,977 | 6/1990 | Beeman et al. . | |
| 4,938,415 | 7/1990 | Walker et al. . | |
| 4,945,711 | 8/1990 | Crittenden . | |
| 4,949,835 | 8/1990 | Beeman et al. . | |
| 4,984,734 | 1/1991 | Zion et al. . | |
| 4,998,666 | 3/1991 | Ewan . | |
| 5,035,328 | 7/1991 | Kim . | |
| 5,050,741 | 9/1991 | Kim . | |
| 5,054,618 | 10/1991 | Kim . | |
| 5,060,848 | 10/1991 | Ewan . | |
| 5,088,720 | 2/1992 | Beeman et al. . | |
| 5,098,757 | 3/1992 | Steel . | |
| 5,135,790 | 8/1992 | Kaplan et al. . | |
| 5,203,634 | 4/1993 | Kim . | |
| 5,209,353 | 5/1993 | Lehtovaara . | |
| 5,213,258 | 5/1993 | Kim | 229/309 X |
| 5,248,034 | 9/1993 | Janhonen . | |
| 5,294,470 | 3/1994 | Ewan . | |
| 5,419,433 | 5/1995 | Harrer et al. . | |
| 5,421,453 | 6/1995 | Harrer et al. . | |
| 5,503,328 | 4/1996 | Roccaforte et al. | 383/5 X |
| 5,505,376 | 4/1996 | Kent et al. | 229/311 |
| 5,683,029 | 11/1997 | Lyons | 229/309 |
| 5,799,865 | 9/1998 | Gray | 229/309 |

FOREIGN PATENT DOCUMENTS

| | | | |
|---|---|---|---|
| 645530 | 9/1991 | Australia | 229/309 |
| 2671331 | 7/1992 | France | 383/5 |
| 510989 | 8/1939 | United Kingdom | 229/313 |
| 9323302 | 11/1993 | WIPO | 229/313 |

*Primary Examiner*—Jes F. Pascua
*Attorney, Agent, or Firm*—Nancy N. Quan

[57] ABSTRACT

A blank for a container and the container afford a structure wherein the adhesive closure for the container also forms a tear strip to allow easy opening of the envelope once it is sealed.

7 Claims, 5 Drawing Sheets

BLANK FOR A CONTAINER, AND A CONTAINER HAVING A CLOSING AND OPENING SYSTEM

RELATED APPLICATIONS

This application is a continuation of application Ser. No. 08/650,096 filed May 17, 1996, now abandoned.

BACKGROUND OF THE INVENTION

1. Field of the Invention

This invention relates to an improvement in a blank for making a container or envelope and in one aspect relates to an improved closing and opening system for containers such as envelopes.

2. Description of the Prior Art

The commercially available envelopes for mailing and for overnight delivery parcels have adhesive closure systems and many have tear strips for facile opening. One such opening system is illustrated in U.S. Pat. No. 4,781,296 for use on envelopes of tough non-woven thermoplastic fibers. Another easy open strip is shown in U.S. Pat. No. 4,778,059 showing a tear strip for use on a corrugated shipping carton. Similarly, U.S. Pat. No. 5,098,757, available from the assignee of this patent (application) illustrates a further structure for a tear strip for a corrugated package or carton. This later patent discloses a hot melt coated tear tape adhered to the outside surface of the inside liner along the desired line of opening and a hot melt coated tear guide tape, at least as wide as the tear tape, adhered to the inside surface of the outside liner. The two adhesives are separate and do not join one another but both serve to provide the desired even tear line.

U.S. Pat. No. 4,877,139 discloses a container having an opening-closing flap provided with a strip of adhesive disposed along a straight line on the inside surface of the flap for sealing the container, and a non-tearable guide strip disposed along the outside surface and a non-tearable elongate straight tear band attached to the inside surface of the flap along a perforated punch line to allow the opening with one edge of the tear band aligned with an edge of the guide strip so that when the flap is sealed by the adhesive and the tear band is freed and pulled away from the container, the container is opened with a tear line which extends along the container flap in a straight line.

The present invention affords a single adhesive strip on the closing-opening flap to seal the container closed and to provide a facile tear strip to open the flap and container once it is sealed.

The present invention further has the advantage that the manufacturer of the container or envelope has only one tape or ribbon to inventory. Only one tape to guide and apply during manufacture of the envelopes. And, only one piece of tape applicating equipment on the line.

SUMMARY OF THE INVENTION

The present invention is directed to a blank and to a container, e.g. an envelope or box, made from a blank to provide an easy to close and easy to open container for articles. The closure and opening system uses a single strip of adhesive on a closure flap. The adhesive, a ribbon or strip, e.g. a tape, has good tensile strength and it may be reinforced with filaments extending lengthwise or longitudinal of the strip of adhesive, or comprise a polymeric backing having the necessary strength properties and coated on opposite sides with adhesive.

A blank for forming a container comprises a sheet of material such as linerboard, which is generic for many types of sheet stock used for making folders, envelopes, corrugated packaging, etc., which sheet is formed with a plurality of score lines forming front and back panels, connecting flaps, and a closure flap or flaps. The panels are generally of equal dimension joined by a score line to each other or by score lines to a connecting flap. The panels may have one or more tabs extending from other free edges and separated by a score line to fold and engage another flap or the other panel to form the container. One of the panels has cuts formed along the free edge to form a pull tab, and the other panel has a flap connected by another score line for forming an opening and closing flap for the container. The flap has ends formed with cuts to define pull tabs, and the adhesive ribbon or strip extends along the flap between the pull tabs for sealing the flap to the other panel and for use to tear the flap free of the panel.

A container formed from the blank has panel means forming two opposing parts of the container, a plurality of tabs for closing the sides or for closing a side and the bottom edge of said container, and one of said panels has a closing and opening flap (sealing flap) along the top edge thereof adapted to fold over the outside surface of the other panel, or over a flap on the other panel, to close and seal the container. The sealing flap has an inside surface and an outside surface and ends adjacent the sides of the panel means, and a ribbon or strip of adhesive is disposed along the inside surface of the sealing flap and generally parallel with a second edge of the panel means to seal the sealing flap to the other panel of the panel means and form a closure with the opposite panel. The adhesive has sufficient bond strength to the sealing flap and to the other panel to tear the flap and at least a portion of the other panel to afford easy opening of the flap and access to the inside surfaces of the container when an end of the strip is pulled in a direction back upon itself.

These and other novel features of the invention will be more fully described hereinbelow.

BRIEF DESCRIPTION OF THE DRAWINGS

The present invention will be described with reference to the accompanying drawing wherein.

DESCRIPTION OF THE PREFERRED EMBODIMENTS

The present invention provides an improved container, e.g. an envelope for delivery of an article such as used for overnight carton mailers, corrugated box mailers, CD mailers, computer disk mailers, photograph mailers, book mailers and other prepared envelopes for use in mailing documents without folding the contents, or small packages for such articles as food items, e.g. bacon, luncheon meats, cheese, or paper items, e.g. stationary, paper, labels, and other articles commonly packaged.

Figure 1:
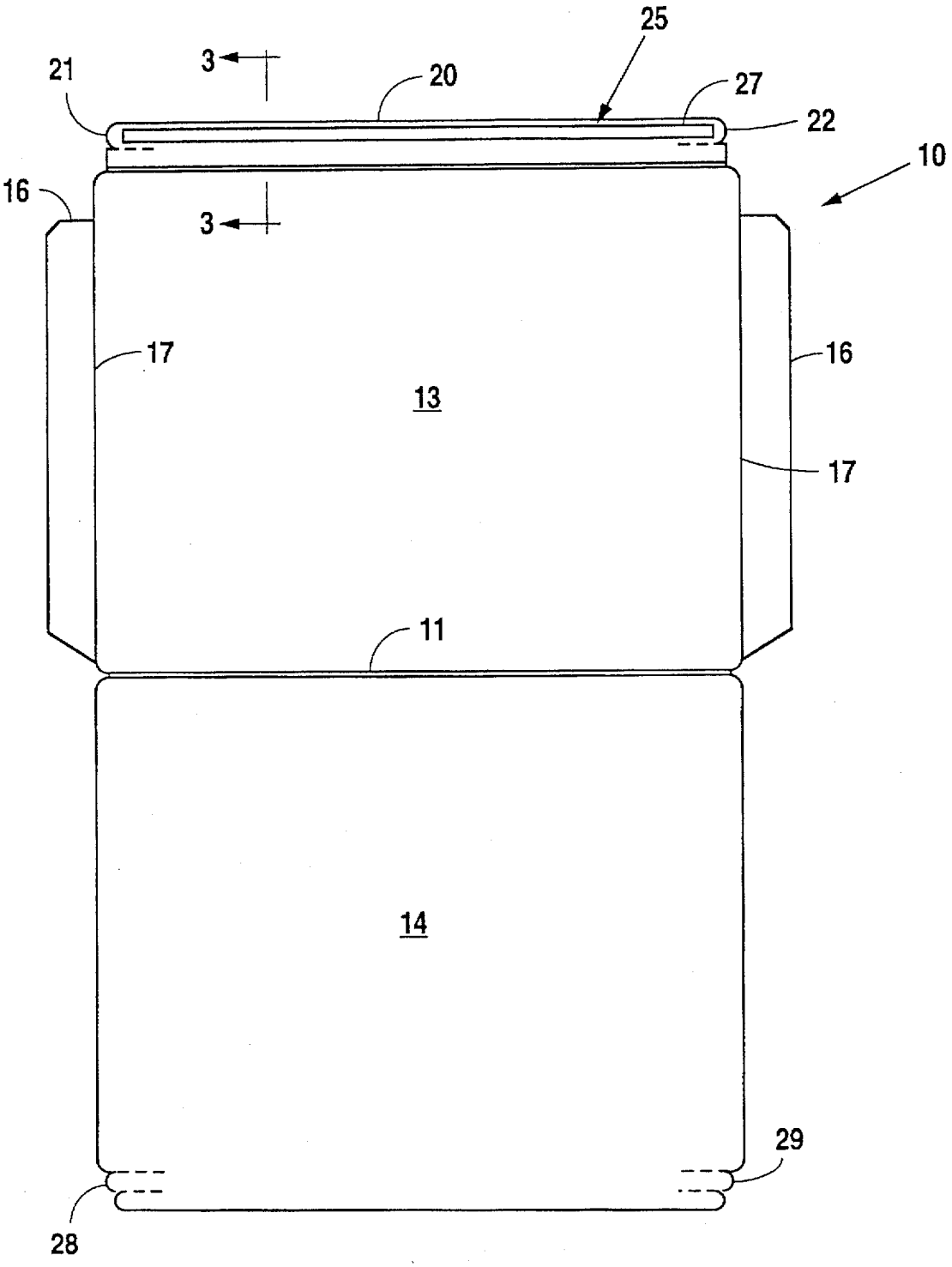
FIG. 1 is a plan view of a blank for forming a container according to the invention.
Figure 4:
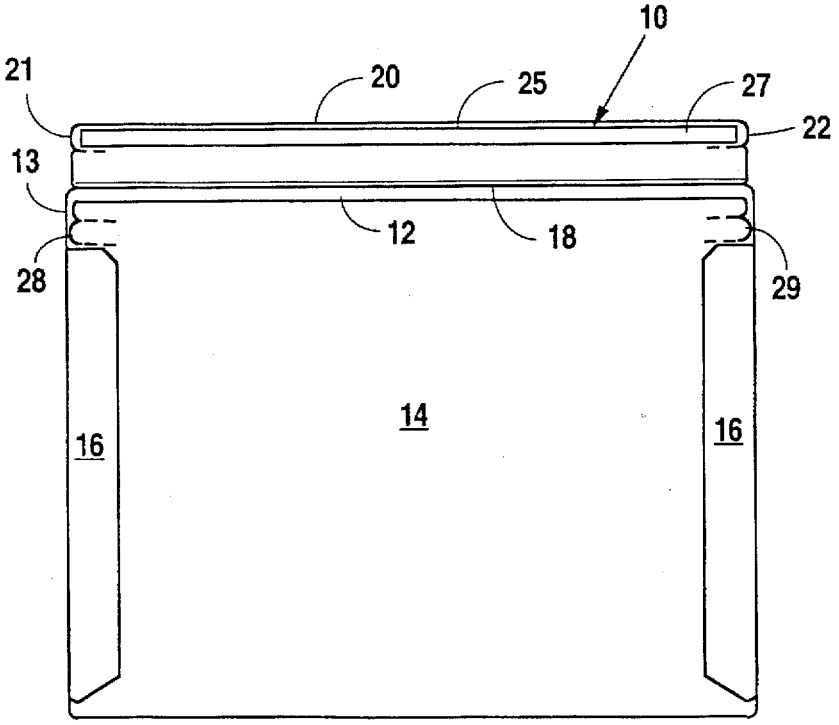
FIG. 4 is an elevational view of an envelope formed according to the present invention from the blank of FIG. 1.

The blank 10 illustrated in FIG. 1 is a blank to form an envelope. The blank 10 comprises a sheet of linerboard, fiberboard clay coated white, having a score line 11 dividing the sheet into a pair of panels 13 and 14 along a first edge, the inside surfaces of the panels are exposed, and they are of generally equal dimension. The panels 13 and 14 are of generally equal dimension, even if one panel 13 has a riser or narrow strip 12 extending beyond the second edge of the panel 14, see FIG. 4. The strip 12 affords ease in opening the envelope for the insertion of an article, e.g. for the mechanical insertion of material into the envelope. The side edges of the panel 13, as illustrated, have tabs 16 joined thereto by score lines 17. The tabs 16 are adapted to fold over the sides of the panel 14 when it is folded along the score line 11 to form the sides of the envelope, as seen in FIG. 4.

Beyond the strip 12, the panel 13 has a score line 18 joining a sealing flap 20 to the top or second edge of the panel 13. The flap 20 has ends which terminate adjacent to the side edges of the panel 13 and the flap ends have cut lines extending from the ends into the flap 20 defining tabs 21, 22 having a arrow shaped end or a rounded end, to characterize a tab. Except for the cut lines forming the tabs 21, 22, the flap 20 is free of perforations extending across the length of the flap between the ends. Positioned along the free edge of the sealing flap 20 and between the tabs 21 and 22, is adhered an oriented ribbon or strip of adhesive 25, preferably a strip of pressure sensitive adhesive. The adhesive is reinforced to have good tensile strength. Discussion of the adhesive will follow. In the illustrated embodiment the adhesive 25 is continuous and extends generally the length of the sealing flap 20 and parallel to the edge of the sealing flap 20. Positioned over the strip of adhesive is a removable liner 27, positioned to protect the exposed side of the adhesive strip 25 until it is desired to seal the flap 20 to the outside surface of the panel 14. The liner 27 has a greater width than the adhesive strip 25 for easy removal. The liner 27 is then removed and the sealing flap 20 is folded to position the adhesive 25 along the edge of the panel 14. It is to be noted that the top edge or second edge of the panel 14 is free of perforations extending between sides but is formed with cut lines to form tab shaped ends 28 and 29 at the sides. These tabs 28 and 29 register with the tabs 21 and 22 respectively, when the flap 20 is folded over the top edge of the panel 14 and the adhesive 25 is secured along the second edge of the panel 14, see FIGS. 7 and 8.

In the manufacture of the blanks, the adhesive can be applied to the liner board or to a cut blank. Thus, the adhesive is applied either continuously on the sheet or intermittently on the blanks using industry standard pressure wheels and cutters, or vacuum wheel applicating equipment.

Figure 7:
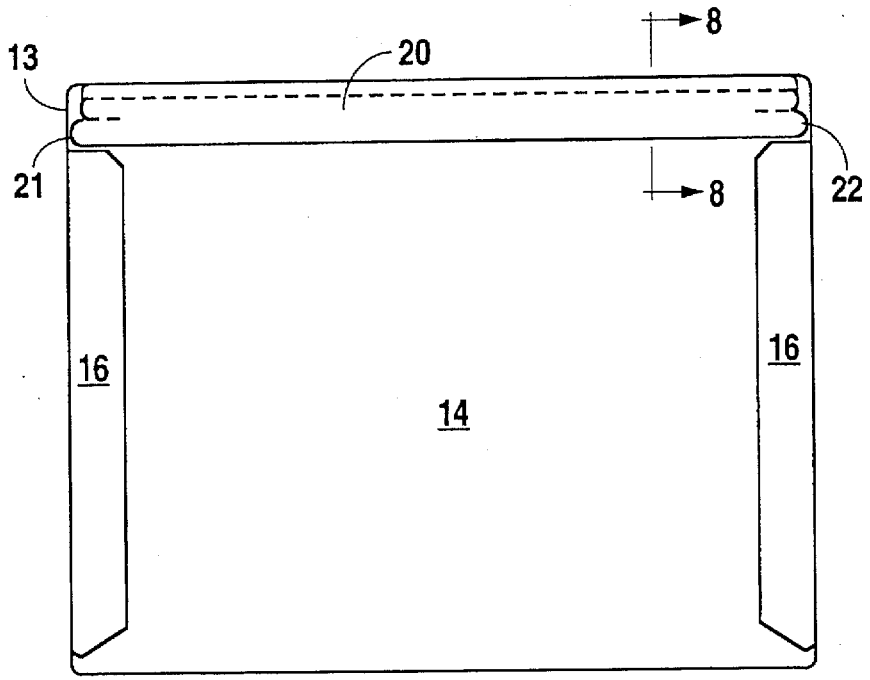
FIG. 7 is an elevational view of an envelope formed from the blank of FIG. 1 with the flap in closed position.

To afford facile opening of the envelope, see FIG. 7, a tab 21 or 22, together with the respective tab 28 or 29, are peeled back upon themselves tearing the flap and second edge of the panel 14 free from the envelope to break the seal and permit the remaining portion of the flap 20 to be moved to allow access to the contents of the envelope.

The adhesive 25 is preferrably a pressure sensitive adhesive. The pressure sensitive adhesive can be a hotmelt, water based or solvent based adhesive. The adhesive 25 illustrated has a plurality of fibers 26 of a strong material such as polyester, Nylon, fiberglass, Rayon, or other continuous filament, embedded in the layer of adhesive. The fibers extend the length of the strip of adhesive. Alternatively, the adhesive 25 is a double coated tape, having a strong backing material, such as oriented polyester, with a layer of the adhesive coated and adhered to each side. The internal bond strength of the adhesive, and the bond of the adhesive to the surfaces of the linerboard exceed the strength of the bond of the fibers forming the linerboard. This permits the adhesive strip 25 to form a firm bond to close the flap and when the tabs 22 and 29, for example, are pulled and peeled back upon the envelope the adhesive bond with the flap 20 in the area of tab 22 has sufficient strength to tear the edge of panel 14 with tab 29 to open the envelope. The adhesive with the longitudinal fibers has a lower shear strength to permit the adhesive to tear lengthwise along the sealing flap 20. This permits the adhesive to tear lengthwise, as is done to afford the tearing of the central portion of the flap and adhesive which closure system is the subject of the next embodiment of the invention.

Figure 2:
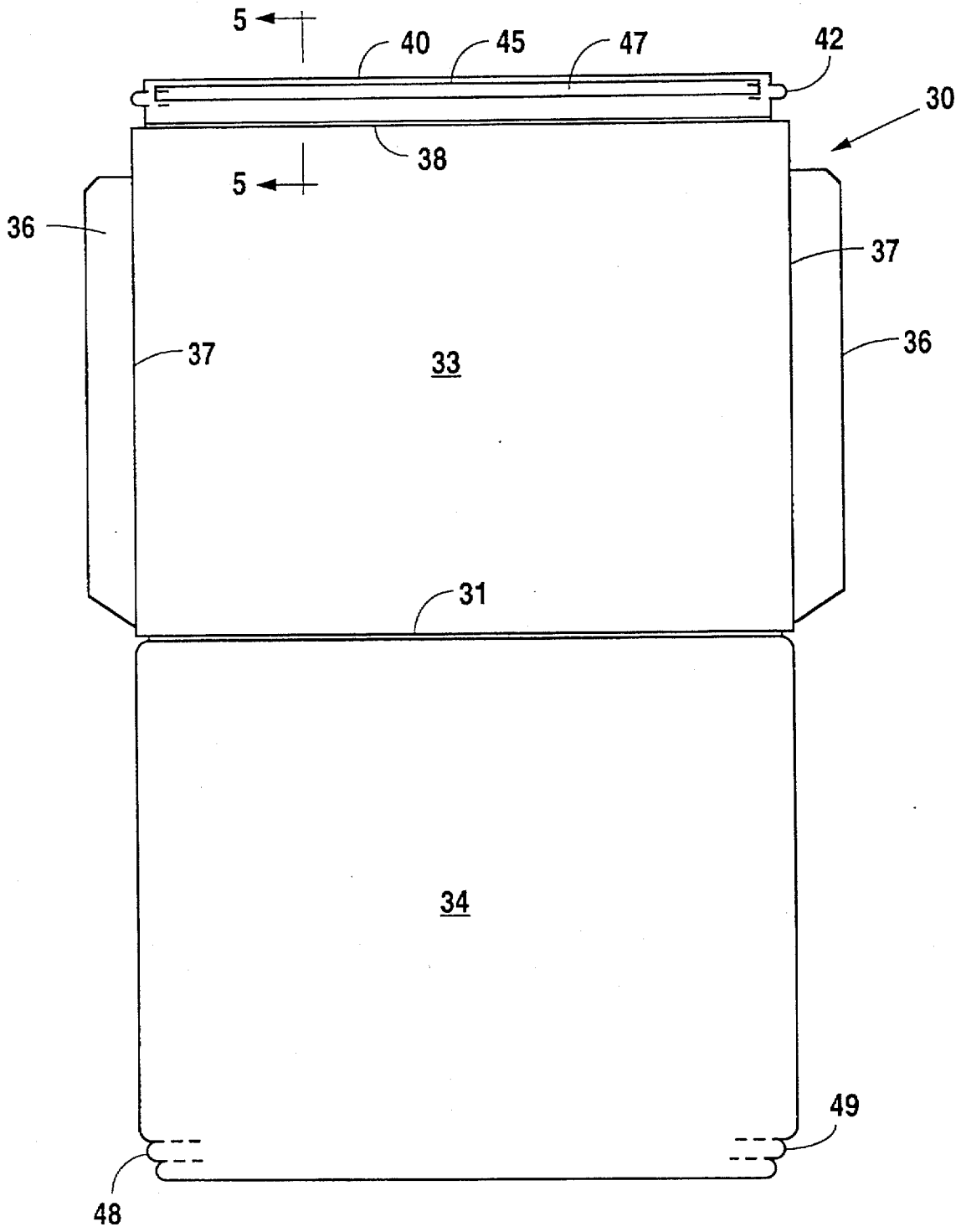
FIG. 2 is a plan view of a second blank for forming a container according to the present invention.

Referring now to FIG. 2, a blank 30 is illustrated wherein the peeling of the tab tears a portion of the sealing flap 40 along its length through the middle of the flap to open the envelope, but a portion of the sealing flap 40, the adhesive 45 and a portion of the other panel remain sealed.

The blank 30 comprises a sheet of linerboard having a score line 31 dividing the sheet into a pair of panels 33 and 34, along a first edge, of generally equal dimension. One of the panels could be provided with a window, not shown, covered or not with clear film, to display the contents inside, or an address area on the contents. The panels 33 and 34 are of generally equal dimension, even if one panel 33 has a riser or narrow strip 32 extending beyond the second edge of the panel 34. This narrow strip 32 affords ease in opening the envelope for the insertion of an article. The side edges of the panel 33, as illustrated, have tabs 36 joined thereto by score lines 37. The tabs 36 are adapted to fold over the sides of the panel 34 when it is folded along the score line 31 to be bonded to the front or outside surface of panel 34 in the usual manner to form the envelope.

Beyond the strip 32, the panel 33 has a score line 38 joining the sealing flap 40 to the top edge of the panel 33. The flap 40 has ends which terminate adjacent to the edges of the panel 33 and the ends are cut to form a cut line extending from the ends into the flap 40 and the ends are formed by cut lines with tabs 41, 42 having a arrow shaped end or a rounded end, to characterize a pull tab. The cut lines forming the tabs 41, 42 do not extend across the length of the flap 40 and the flap 40 is preferably free of perforations extending across the length of the flap between the cut lines forming the tabs at the ends of the flap 40. Positioned along and adhered adjacent to the free edge of the flap 40 and between the tabs 41 and 42, is a ribbon or strip of adhesive 45, preferably a strip of pressure sensitive adhesive as discussed above. Positioned over the adhesive 45 is a removable release liner 47, positioned to protect the exposed side of the adhesive 45 until it is desired to seal the flap 40 to the outside surface of the panel 34. The liner 47 is easily removed and the flap 40 is folded to position the adhesive 25 along the edge of the panel 34. It is to be noted that the top edge or free edge of the panel 34 is also formed with cut lines to form tab shaped ends 48 and 49 at the sides. The panel 34 is also free of perforations extending across the panel between the ends of the cut lines. These tabs 48 and 49 register with the tabs 41 and 42 respectively, when the flap is folded over the top edge of the panel 34 and the adhesive 45 is secured along the edge of the panel 34.

Figure 6:
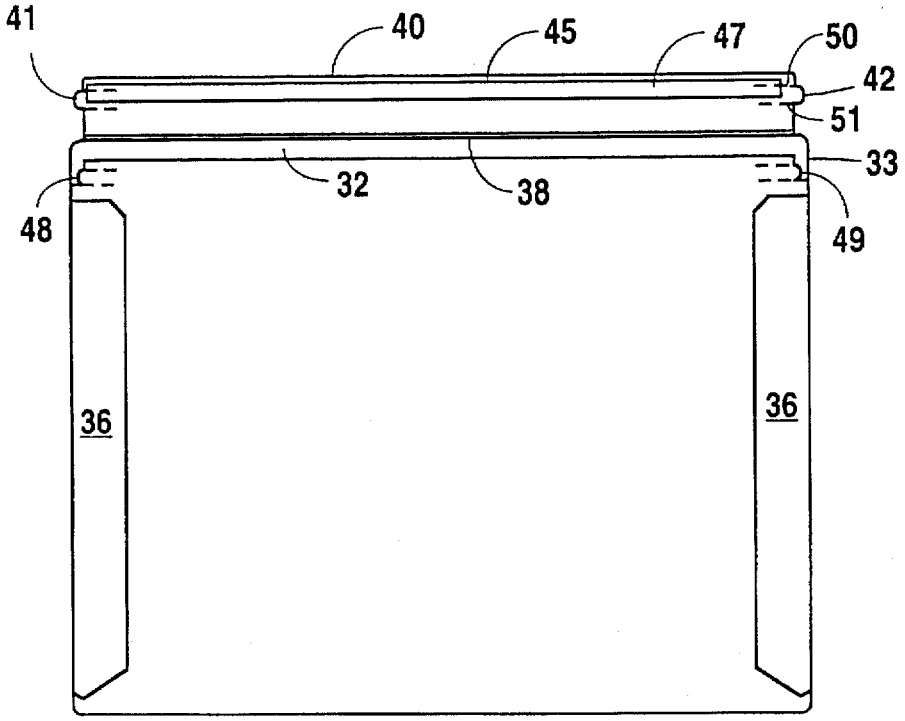
FIG. 6 is an elevational view of an envelope formed according to the present invention from the blank of FIG. 2.

Opening this envelope requires simply grasping a tab 41 or 42 and the corresponding tab 48 or 49 and tearing the tab along the cut lines 50 and 51 to tear the center portion of the flap 40 and the corresponding portion of the adhesive from the envelope. The sectional view of FIG. 6 illustrates that the fibers and adhesive separate the flap 40 from the edge of the panel 34 but when peeled away, the adhesive will tear lengthwise and a portion of the flap is removed and the edge of the flap 40 remains sealed to the panel 34.

Figure 3:
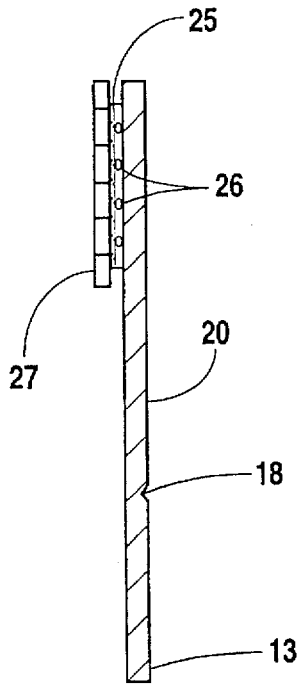
FIG. 3 is fragmentary detail sectional view of the blank of FIG. 1 taken along the line 3—3 on FIG. 1.
Figure 5:
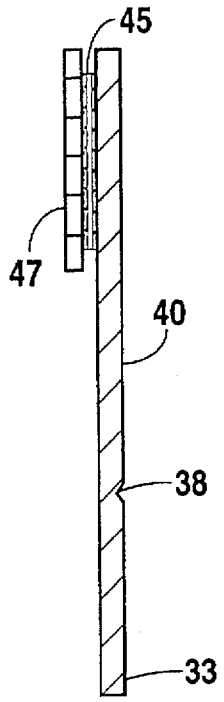
FIG. 5 is fragmentary detail sectional view of the blank of FIG. 2 taken along the line 5—5 on FIG. 2.

FIGS. 3 and 4 illustrate the completed envelope formed from the blank of FIG. 1. FIGS. 5 and 6 illustrate the finished envelope formed from the blank of FIG. 2. FIG. 7 illustrates the envelope of FIG. 4 closed to provide a container for documents, with the liner 27 removed and the adhesive 25 adhering the flap 20 to the panel 14. The adhesive thus forms a firm closure. The envelope is opened by grasping the tabs 22 and 29 or the tabs 21 and 28 to tear the portion of the flap 20 and the panel 14 to permit opening of the container.

Figure 8:
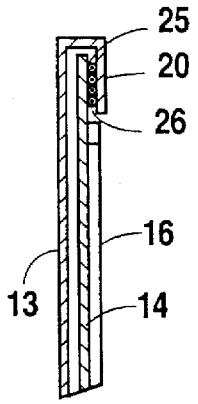
FIG. 8 is a detail sectional view taken along line 8—8 of FIG. 7.

FIG. 8 provides a cross-section of the sealed closure to illustrate the position of the adhesive 25, the flap 20 and the panels 13 and 14.

Figure 9:
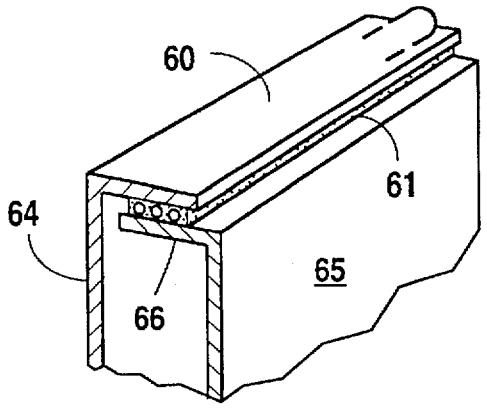
FIG. 9 is a fragmentary detail view, partially in section of a further embodiment of a container according to the present invention formed by closing the sealing flap onto another flap on the second edge of the opposite panel to form a box like container.

FIG. 9 illustrates how a sealing flap 60 with an adhesive 61 can form a similar closure for a container with panels 64 and 65 spaced apart, with each panel having a flap to be joined by the adhesive, see flap 66 on panel 65. The flaps 60 and 66 have ends formed similar to the ends of the flaps 20 and 40, and the sides of panel 14 and 34 to form tabs to facilitate the opening of the container at the flaps 60, 66. Such a container can be used as discussed above for packaging articles such as food items, paper items, etc.

Having described the invention with reference to accompanying illustrations of the invention, it is contemplated that other engineering changes can be made without departing from the spirit or scope of the invention as set forth in the appended claims.

We claim:

1. An envelope for delivery of an article comprising means forming a front and rear panel for defining an enclosure, each panel having an inside and outside surface, a first edge and a second edge, and opposite side edges, at least one of said panels having sealing tab along each side edge which will fold to join the other panel to close the side edges, one of said panels having a closing and opening flap along the second edge to fold over the outside surface of the other panel to seal the second edge, said flap having an inside surface and an outside surface and ends adjacent the side edges of the panels, and an adhesive strip disposed and adhered along the inside surface of said flap and generally parallel with the second edge of said panels to engage and seal the flap to an outside surface of the other panel and to form a bond with said other panel, said flap and said other panel having cut lines adjacent to the ends of said flap and to the ends of said adhesive strip for forming pull tabs but being free of perforations between the cut lines at the ends of said flap, and said adhesive strip being reinforced by a continuous member and having sufficient bond strength to the flap and to the outside surface of said other panel to tear the flap and at least a portion of said other panel, to afford easy opening of the flap and access to the inside surfaces of the panels when an end of said adhesive strip and a pull tab on said flap is pulled in a direction back upon itself.

2. An envelope according to claim 1 wherein said panels, said flap and a said sealing tab are formed from a single sheet of clay coated fiberboard.

3. An envelope according to claim 1, wherein said adhesive strip is provided with a removable liner to protect the adhesive until the flap is to be sealed.

4. An envelope according to claim 1, wherein said second edge of said other panel is formed with cut lines forming pull tabs adjacent its side edges but being free of perforations between said cut lines whereby said flap and said edges of said other panel have tabs aligned with the ends of said strip of adhesive to afford easy access to the end of the adhesive strip.

5. An envelope according to claim 1 wherein said adhesive strip comprises reinforcing means for longitudinal strength to permit easy continuous tearing of the flap when a pull tab and the adhesive strip are pulled back upon themselves.

6. A blank for forming an envelope-like container, said blank comprising a sheet of linerboard having a plurality of score lines forming a pair of panels of equal dimension joined by a score line, one of said panels having tabs at the side edge extending therefrom and separated by a score line to fold and engage the other panel to form sides of the envelope having a first closed edge, one of said panels having cut lines formed along a second edge to form a pull tab, a flap connected by another score line to an edge of the other panel for forming an opening and closing flap for the container, said flap having ends and having cut lines adjacent said ends to define pull tabs at said ends but being free of perforations extending across the flap between said cut lines, and a strip of adhesive, being reinforced by a continuous member within the adhesive, bonded to and extending along the flap between the pull tabs for sealing the flap to said other panel and to form a strengthened member to tear the flap and a portion of said other panel free of said other panel to open a said container.

7. A blank according to claim 6, wherein said flap is joined to a second flap formed on the second edge of the other panel for spacing the panels.

* * * * *